United States Patent [19]

Drake

[11] Patent Number: 4,813,166

[45] Date of Patent: Mar. 21, 1989

[54] IRONING BOARD COVER

[76] Inventor: Philip A. Drake, 46 Princeville Cir., Sacramento, Calif. 95831

[21] Appl. No.: 104,938

[22] Filed: Oct. 6, 1987

[51] Int. Cl.[4] ..... D06F 83/00

[52] U.S. Cl. ..... 38/140; 2/DIG. 6; 2/243 B; 108/90

[58] Field of Search ..... 38/140; 2/DIG. 6, 243 B; 108/90; 297/DIG. 6

[56] References Cited

U.S. PATENT DOCUMENTS

| | | | |
|---|---|---|---|
| 823,169 | 6/1906 | Hazard | 38/140 |
| 1,208,643 | 12/1916 | Poll | 38/140 |
| 1,287,597 | 12/1918 | Murray | 38/140 |
| 1,565,373 | 12/1925 | Kohn | 38/140 |
| 1,832,545 | 11/1931 | Grant | 38/140 |
| 2,006,014 | 6/1935 | Doyle | 38/140 UX |
| 2,382,830 | 8/1945 | Sunbury | 38/140 UX |
| 3,049,826 | 8/1962 | Goldsmith | 38/140 |
| 3,143,154 | 8/1964 | Best | 297/DIG. 6 X |
| 4,387,516 | 6/1983 | Laux | 36/43 |
| 4,616,434 | 10/1986 | Riba et al. | 38/140 |
| 4,627,363 | 12/1986 | Jones | 108/90 |
| 4,705,084 | 11/1987 | Rodebaugh et al. | 108/90 X |

FOREIGN PATENT DOCUMENTS

| | | | |
|---|---|---|---|
| 1368088 | 9/1974 | United Kingdom | 2/243 B |

*Primary Examiner*—Robert R. Mackey
*Attorney, Agent, or Firm*—Leon Gilden

[57] ABSTRACT

An ironing board cover is foldable into an interfitting relationship with an appropriate ironing board. The covering includes an associated pad whereupon positioning over an ironing board yields a smooth and continuous ironing surface. The pad is securable by means of a plurality of transverse belts securable by means of Velcro®-type fasteners. The various corner portions of the ironing board pad may optionally also be securable by Velcro® connectors. Gradation lines are formed on both longitudinal side portions of the ironing board cover and at end portions thereof for indication of dimensions which may be accommodated by the ironing board cover of the instant invention.

1 Claim, 1 Drawing Sheet

IRONING BOARD COVER

BACKGROUND OF THE INVENTION

1. Field of the Invention

The present invention relates to ironing board covers, and more particularly pertains to a new and improved ironing board cover which includes a plurality of Velcro ® type i.e. hook and loop fasteners for accommodation of dimensional variations among ironing boards and further provides for gradation indicia to enable visual predetermination of potential accommodation of the ironing board cover to a pre-selected ironing board.

2. Description of the Prior Art

The use of ironing board cover apparatus is well known in the prior art. As may be appreciated, these devices are proportioned for fitting about substantially uniform ironing boards. Variations of ironing board size, however, has required in the past ironing board covers and associated pads to be formed in a variety and range of sizes. There exists therefore a need for a new and improved ironing board cover to accommodate the noted ironing board size and variations. Examples of prior devices include U.S. Pat. No. 2,866,284 to McCrory. The ironing board cover of this particular patent utilizes a pad secured to an associated ironing board with a plurality of separate fasteners such as screws or nails. The awkwardness and bulkiness and rather limited applicability to a variety of ironing boards renders the particular patent somewhat limited.

U.S. Pat. No. 3,007,267 to Goldsmith sets forth a multilayered ironing board cover and pad utilizing an elastomeric band member for securement in maintaining a somewhat taut covering condition. The cover of Goldsmith, as in other prior art devices, is limited by its applicability to a somewhat unitary dimensional ironing board. Similarly, U.S. Pat. No. 3,049,826 also to Goldsmith is merely another in a series of ironing board covers wherein this further Goldsmith patent sets forth use of a circumferential drawstring to secure the pad to the ironing board itself.

U.S. Pat. No. 3,562,934 to Cogar sets forth a peripheral drawstring; however in this instance, the drawstring is in the form of an elongate spring member securable at either end to the ironing board proper for tensioning same about an ironing board. The cumbersome and awkward construction of the Cogar patent has resisted its applicability in use to a wide variety of ironing boards, as does the instant invention.

U.S. Pat. No. 3,636,644 to Janetzke sets forth an ironing board cover with an integrally secured no-scorch pad portion for the resting of an iron thereon. The ironing pad in this particular instance is typical of this class of invention wherein a bias tape is utilized in securement of the cover.

U.S. Pat. No. 3,733,724 to Davis illustrates the use of a multi-layer pad utilizing conventional drawstring means for securement to an ironing board therearound. The drawstring means in this patent, as in U.S. Pat. No. 3,911,603 to Lehrman is typical of the conventional means of securing an ironing board pad to a cover that inherently limits its applicability to a variety of ironing board sizes. Furthermore, in this same category of securement U.S. Pat. No. 4,484,400 also to Lehrman is another example of the category of drawstring securement means utilized by ironing board pads of the prior art.

U.S. Pat. No. 4,557,062 to Mattesky is a departure from other prior art devices in the use of a form-fitting pad eliminating the need for drawstrings and the like but accordingly limits the applicability of ironing board pads of this class.

As such it may be appreciated that there is a continuing need for a new and improved ironing board covering pad which addresses both the problem of adaptability and securement about an ironing board and in this respect, the present invention substantially fulfills this need.

SUMMARY OF THE INVENTION

In view of the foregoing disadvantages inherent in the known types of ironing board covers now present in the prior art, the present invention provides an ironing board cover which may be efficiently and easily secured about ironing boards of different manufacturing dimensional variations. As such, the general purpose of the present invention, which will be described subsequently in greater detail, is to provide a new and improved ironing board cover which has all the advantages of the prior art ironing board covers and none of the disadvantages.

To attain this, the present invention utilizes an ironing board cover securable about an associated ironing board by means of a plurality of transverse Velcro ® straps. Furthermore, the nose and heel portion of the ironing board cover may also be securable about an ironing board by means of Velcro ® fastening attachment means to accommodate variations in ironing board dimensions and in maintaining desired tautness and smoothness of the ironing board cover about an associated ironing board. Furthermore, gardation lines are formed on the ironing board pad either by sewing or coloration or other equivalents to enable visual illustration of the applicability of the instant ironing board pad to a pre-selected ironing board.

My invention resides not in any one of these features per se, but rather in the particular combination of all of them herein disclosed and claimed and it is distinguished from the prior art in this particular combination of all of its structures for the functions specified.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ironing board cover which has all the advantages of the prior art ironing board covers and none of the disadvantages.

It is another object of the present invention to provide a new and improved ironing board cover which may be easily and efficiently manufactured and marketed.

It is a further object of the present invention to provide a new and improved ironing board cover which is of a durable and reliable construction.

An even further object of the present invention is to provide a new and improved ironing board cover which is susceptible of a low cost of manufacture with regard to both materials and labor, and which accordingly is then susceptible of low prices of sale to the consuming public, thereby making such ironing board covers economically available to the buying public.

Still yet another object of the present invention is to provide a new and improved ironing board cover which provides in the apparatuses and methods of the prior art some of the advantages thereof, while simultaneously overcoming some of the disadvantages normally associated therewith.

Still another object of the present invention is to provide a new and improved ironing board cover wherein a plurality of Velcro ® fasteners are utilized to secure the ironing board cover about an associated ironing board.

Even still another object of the present invention is to provide a new and improved ironing board cover utilizing gradation lines to provide visual demonstration of the adaptability of the ironing board pad to a preselected dimensional size of ironing board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
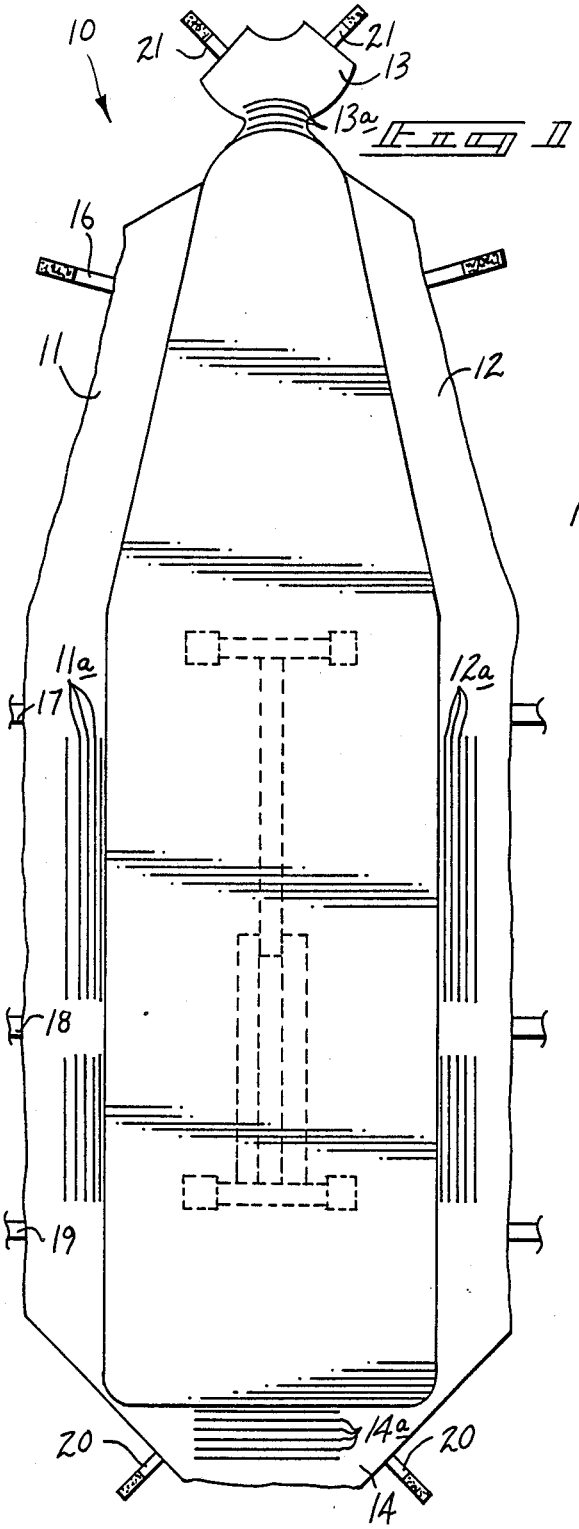
FIG. 1 is a top orthographic view of the instant invention illustrating the ironing board pad prior to installation about an ironing board.

With reference now to the drawings, and in particular to FIG. 1 thereof, a new and improved ironing board cover embodying the principles and concepts of the present invention and generally designated by the reference numeral 10 will be described.

Figure 2:
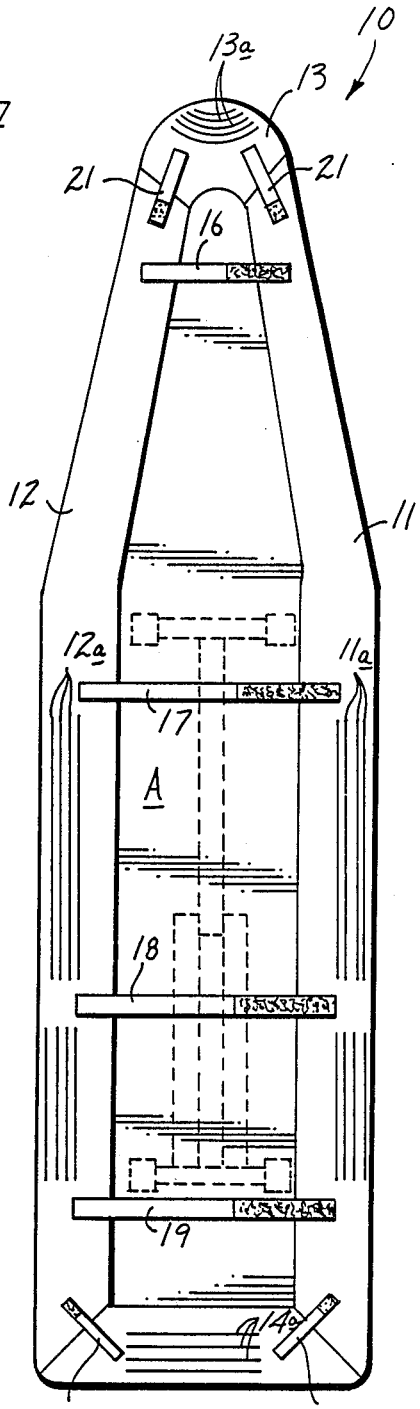
FIG. 2 is an orthographic bottom view of the instant invention illustrating the ironing board pad secured about an associated ironing board.

To attain this, the present invention comprises an ironing board cover 10 including a plurality of integrally associated peripheral flaps. A first longitudinal flap 11 is positioned on the left side of the ironing board cover about central portion 15 and accordingly a second longitudinal flap 12 is contiguously adjoined to central portion 15 at a right side. A nose flap 13 is positioned at a forward orientation of said ironing board cover and a heel flap 14 is positioned rearwardly of said ironing board cover, as illustrated in FIG. 1. The ironing board cover flaps 11, 12, 13, and 14 all have gradation indicia formed on said flaps at positions essentially parallel to the longitudinal perimeter of the associated ironing board and central portion 15. Respective gradations **11*a*, 12*a*, 13*a*, and 14*a* are all formed, as illustrated. The gradation indicia situated on the respective flaps enable visual understanding of the accommodation of the ironing board cover 10 to an associated ironing board. A nominal width of an ironing board is approximately 15 inches and of a length of approximately 4½ feet. As may be appreciated, these dimensions may vary widely throughout the industry among individual manufacturers of ironing boards. The gradation indicia enable understanding as to the positioning of the ironing board cover 10 as it is folded about the ironing board surface and accordingly enables a user to understand the amount of overlap about an ironing board available as the flaps are folded about said ironing board when utilized. It may be appreciated therefore that the utilization of Velcro ® fasteners in combination with my ironing board cover enables accommodation of a wide variety of ironing boards wherein said Velcro ® fasteners enables the continual take up of any slack as the various flaps are folded therearound and accordingly the desired smoothness and tautness desired on an ironing board surface for relation in conjunction with a conventional iron is available. A first, second, third, and fourth lateral Velcro ® fastening element 16, 17, 18, and 19, respectively are positioned, as illustrated in FIG. 2, to achieve the aforenoted securement of the lateral flaps 11 and 12 about an ironing board. Flaps 13 and 14 are secured about the ironing board by cooperating Velcro ® fastening elements 20 and 21 to secure the nose flap 13 to the longitudinal flaps 11 and 12 and Velcro ® fasteners 20 to secure to heel flap to the longitudinal flaps 11 and 12, as illustrated in FIG. 2**.

It may be appreciated that the utilization of four flaps enable the combination of ironing boards that vary both in width and length but if desired, the nose flap 13 and heel flap 14 may be integrally formed to lateral flaps 12 and 11 to enable an accommodation of only a lateral dimensional variation of an ironing board to be utilized, if so desired. The ironing board as depicted is itself of conventional construction and indicated by the letter "A" in FIG. 2. Conventional legs are foldable or slidable upon said board "A" but whose detail of construction and attachment thereto is non-essential to the understanding of the instant invention and are therefore deleted.

As to the manner of usage and operation of the present invention, the same should be apparent from the above description. Accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cover for use in combination with an ironing board comprising, a flexible non-elastic cover material means inluding a first and second lateral flap extending co-extensively and longitudinally about either longitudinal side of a central portion for covering said ironing board;

a nose flap means for enclosing a forward portion of said ironing board and secured at a position forwardly and medially of said first and second flaps, a heel flap means for enclosing a rearward portion of said ironing board and secured at a position rearwardly and medially of said first and second flaps, hook and loop fasteners to secure said flaps about said ironing board to thereby envelope said ironing board;

said hook and loop fasteners including a plurality of hook and loop fasteners extending between said first and second flaps to secure said flaps about said ironing board;

a plurality of hook and loop fasteners for securing said nose flap means to said first and second flaps;

a plurality of hook and loop fasteners for securing said heel flap means to said first and second flaps, and wherein each of said flaps includes spaced parallel gradation indicia means spaced from said central portion integrally formed on said flaps for indicating the applicability of said cover in dimensional relationship to variously sized ironing boards.

* * * * *